US006225606B1

(12) United States Patent
Tsuruta et al.

(10) Patent No.: US 6,225,606 B1
(45) Date of Patent: May 1, 2001

(54) CERAMIC HEATER

(75) Inventors: Hideyoshi Tsuruta, Tokai; Ryusuke Ushikoshi, Tajimi; Kazuaki Yamaguchi, Nagoya, all of (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/222,223

(22) Filed: Dec. 29, 1998

(30) Foreign Application Priority Data

Jan. 8, 1998 (JP) ..... 10-002306

(51) Int. Cl.[7] ..... H05B 3/68; H05B 3/44
(52) U.S. Cl. ..... 219/444.1; 219/544
(58) Field of Search ..... 219/443.1, 444.1, 219/544, 545, 546, 547; 118/725, 726, 621

(56) References Cited

U.S. PATENT DOCUMENTS 4,540,878 * 9/1985 Sato ..... 219/545
4,888,472 * 12/1989 Stitz ..... 219/545
5,475,203 * 12/1995 McGaffigan ..... 219/548
5,484,983 * 1/1996 Roell ..... 219/545
5,573,690 11/1996 Nobori et al. .
5,616,024 4/1997 Nobori et al. .

FOREIGN PATENT DOCUMENTS 5-275434 10/1993 (JP) .
6-260263 9/1994 (JP) .

* cited by examiner

*Primary Examiner*—Sang Paik
(74) *Attorney, Agent, or Firm*—Burr & Brown

(57) ABSTRACT

A ceramic heater includes a ceramic substrate having a heating surface, and a resistance heating element buried inside the ceramic substrate, wherein at least a part of the resistance heating element is constituted by a conductive network member, and a ceramic material constituting the ceramic substrate is filled in meshes of the network member.

4 Claims, 6 Drawing Sheets

CERAMIC HEATER

BACKGROUND OF THE INVENTION (1) Field of the Invention

The present invention relates to ceramic heaters to be used in various semiconductor-producing apparatuses, etching apparatuses, etc.

(2) Related Art Statement

NGK Insulators, Ltd. disclosed a ceramic heater in which a wire made of a metal having a high melting point is buried in a discoid substrate made of a dense ceramic material. This wire is spirally wound inside the discoid substrate, and terminals are connected to both ends of the wire. It was found that such a ceramic heater has excellent characteristics particularly for producing semiconductors. However, this ceramic heater is produced as follows. First, a wire made of the high melting point metal is spirally wound, terminals (electrodes) are attached to both the ends of the wire, and they are annealed in vacuum. On the other hand, a powdery ceramic material is charged inside a press-molding machine, and preliminarily molded to a given hardness, while a depression is formed in a surface of the preliminarily molded body. The above wire is accommodated in the depression, and the ceramic powder is further charged onto the resultant. Thereafter, the resulting powdery assembly is uniaxially press molded to a discoid molded body, and the discoid molded body is sintered by hot press.

However, it is very difficult to carry the resistance heating member from an annealing apparatus to the preliminarily molded body without breaking the shape of the resistance heating element, so that the shape is often unavoidably broken. Further, after the resistance heating element is placed in the depression of the preliminarily molded body, the ceramic powder is filled on the preliminarily body, followed by the uniaxial press molding. However, since the charged density of the powder locally varies, the shape of the resistance-heating element is likely to be broken at that time.

In order to solve the above problems, NGK Insulators, Ltd. proposed in JP-A-5-275434 a method that a metallic foil is placed on a preliminarily molded body, ceramic powder is charged onto the preliminarily molded body, and a discoid molded body is produced by uniaxially press molding the resulting ceramic powdery assembly. According to this method, since the resistance-heating element is made of the metallic foil, which does not deform three-dimensionally different from the wire, the resistance-heating element loses its shape during carrying or placing it. JP-A 6-260263 proposed that a ceramic heater in which a foil-shaped resistor is buried inside a dense ceramic substrate is produced by first preparing a plurality of ceramic shaped bodies by cold isostatic press, laminating the ceramic shaped bodies while placing the foil-shaped resistor between the ceramic shaped bodies, and sintering the laminate by hot press.

The present inventors advanced investigations upon various ceramic heaters, and proceeded with development to decrease the thickness of ceramic heaters. During this, it was found that the substrate could be made thinner in the ceramic heater having the above foil-shaped resistance heating element buried in the dense ceramic substrate than in the ceramic heater having the linear resistance heating element buried therein. However, it was found that the following new problem existed in the heater having the foil-shaped resistance-heating element buried in the ceramic substrate. That is, when ceramic heaters were repeatedly subjected to heat cycles at a number of times in which the ceramic heater was operated at not less than 300° C., e.g., in a high temperature range 300 to 100° C., and then cooled to a temperature range of not more than 100° C., some of the ceramic substrates were partially cracked.

SUMMARY OF THE INVENTION

It is therefore an object of the present invention to provide a ceramic heater having a resistance heating element buried in a ceramic substrate, which ceramic heater makes it possible to decrease the thickness of the ceramic substrate and has high durability upon receipt of heat cycles between a high temperature range and a room temperature range.

The present invention relates to the ceramic heater includes a ceramic substrate having a heating surface, and a resistance heating element buried inside the ceramic substrate, wherein at least a part of the resistance heating element is constituted by a conductive network member, and a ceramic material constituting the ceramic substrate is filled in meshes of the network member.

These and other objects, features and advantages of the invention will be appreciated upon reading the following description of the invention when taken in conjunction with the attached drawings, with the understanding that some modifications, variations and changes of the same could be easily made by the skilled person in the art to which the invention pertains.

BRIEF DESCRIPTION OF THE DRAWINGS

In order to well understand the invention, reference is made to the attached drawings, wherein.

DETAILED DESCRIPTION OF THE INVENTION

Figure 1:
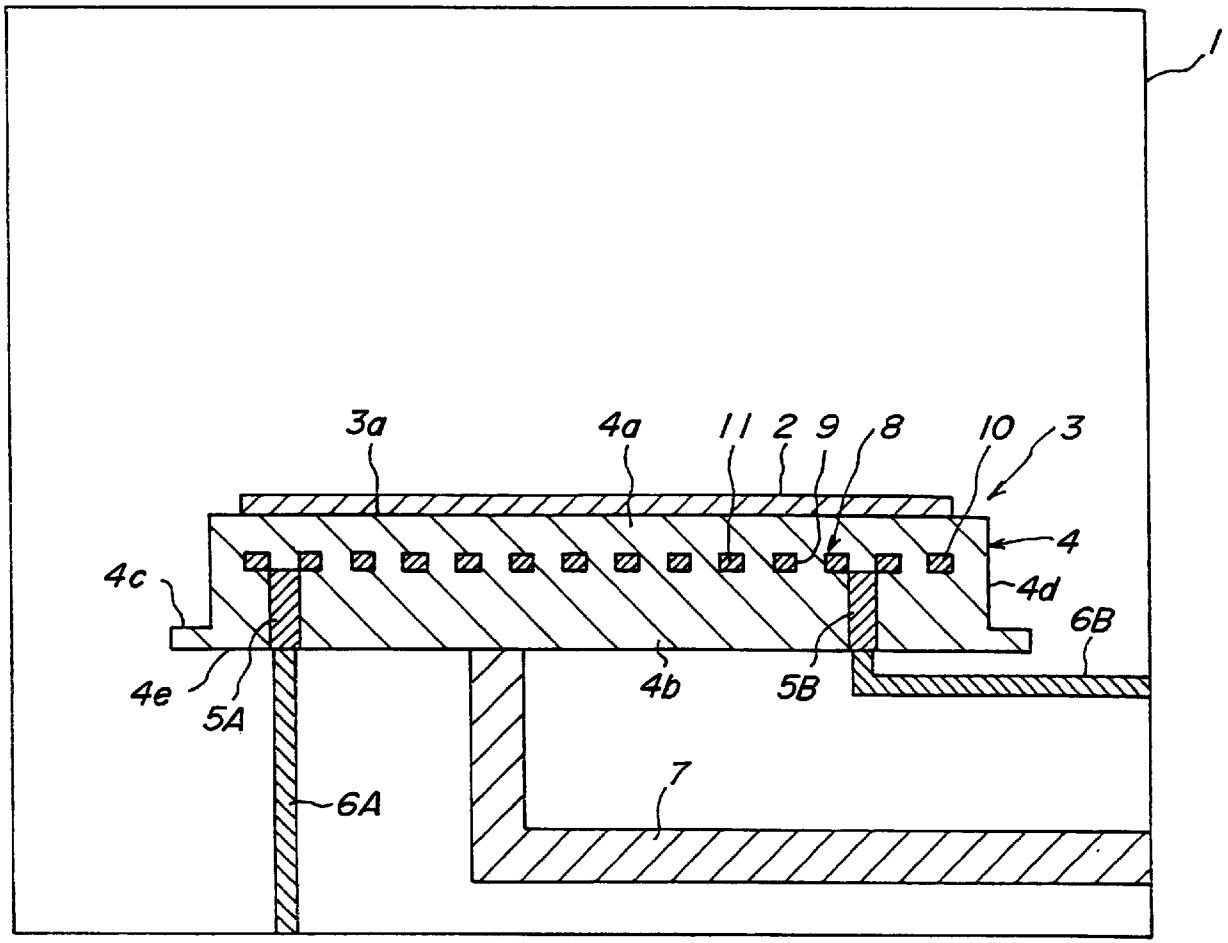
FIG. 1 is a sectional view of schematically showing a state in which a ceramic heater 3 according to one embodiment of the present invention is placed in a chamber.

In the following, the present invention will be described in detail with reference to the attached drawings.

The present inventors investigate what cracked, through the heat cycling, the ceramic substrates in which the foil-shaped resistance-heating element was buried, and the inventors reached the following tentative conclusion. That is, since adhesion between the metal and the ceramic material is poor in the heater having the metallic foil buried as the resistance-heating element, a very small gap is formed between the main plane of the metallic foil and the ceramic material. This very small gap hinders heat conduction, so that heat radiation is likely to occur to increase a temperature difference between the metallic foil and the ceramic material. As the temperature rises, the temperature of the ceramic material is lower than that of the metallic foil, so that the heat expansion of the metallic foil is conspicuously larger than that of the ceramic material to locally apply heat stress upon the ceramic material from the metallic foil.

On the other hand, the main plane of the metallic foil continuously extends as a flat surface, whereas the ceramic substrate gives a large flat surface defect to the flat surface of the metallic foil. It is considered that if such a large flat surface defect exists and heat stress is locally applied to a part of the ceramic substrate facing this flat surface defect, stress concentrates upon the ceramic substrate, which becomes a starting point from which a crack is formed.

After the present inventors made various investigations upon structures being capable of preventing such cracks, they discovered that a structure in which a network member is buried inside a ceramic substrate and a ceramic material is filled in meshes of the network member exhibits remarkable durability particularly against repeated heat cycles between a high temperature range and a low temperature range, particularly a room temperature range. The inventors reached the present invention based on this discovery.

As the ceramic material constituting the ceramic substrate, nitride-based ceramics such as silicon nitride, aluminum nitride, boron nitride and sialon, and an alumina-silicon carbide composite material are preferred. According to the present inventors' investigation, silicon nitride is preferred from the standpoint of view of heat shock resistance, whereas aluminum nitride is preferred from the standpoint of corrosion resistance against a halogen-based corrosive gas.

If particularly, if aluminum nitride having a relative density of 99% or more and a fluorine-based corrosive gas are used, a reaction product layer is formed in the form of a passivation layer made of $AlF_3$ on a surface region of the ceramic substrate. This layer exhibits a corrosion-resisting function, and can prevent corrosion from proceeding over this layer. Dense aluminum nitride having a relative density of 99.9% or more produced by atmospheric pressure sintering, hot press sintering or hot CVD is preferred.

Aluminum nitride is known as a corrosion-resistive ceramic material. However, the ordinary corrosion-resistive ceramic material is referred to when ionic reactivity for an acid or alkaline solution is of concern. In contrast, according to the present invention, the damage due to plasma bombardment is of concern instead of the ionic reactivity, while reactivity between the halogen-based corrosive gas and plasma in a moisture-free state is also of concern.

When the ceramic heater is used for the semiconductor-producing apparatus, contamination of the semiconductors with a heavy metal needs to be prevented. Particularly with the increase in highly intensified integration, exclusion of such a heavy metal is highly demanded. From this point of view, the content of a metal other than aluminum in aluminum nitride is preferably suppressed to 1% or less.

The material of the network member buried in the ceramic substrate is not limited, but it is preferable to make the network member of a high melting point in an application in which the ceramic heater is heated to a high temperature, in particular 600° C. or more. As such a high melting point metal, tantalum, tungsten, molybdenum, platinum, rhenium, hafnium and their alloys are recited by way of example. Tantalum, tungsten, molybdenum, platinum and their alloys are preferred from the standpoint of of the prevention of the semiconductor contamination in an application in which the ceramic heater is placed in the semiconductor-producing apparatus.

Particularly, a metal containing at least molybdenum is preferred. Such a metal may be pure molybdenum or an alloy between molybdenum and another metal or other metals. Tungsten, copper, nickel and aluminum are preferred as a metal to be alloyed with molybdenum. As a conductive material other than the metals, carbon, TiN and TiC may be mentioned by way of example.

The shape of the material constituting the network member is preferably fibrous or linear. If the sectional shape of the fibrous material or linear or wire-shaped material is circular, stress concentration caused by thermal expansion can be effectively reduced.

In a preferred embodiment of the present invention, the resistance-heating element is made of a network member and a metallic bulk body integrated with the network member. This embodiment will take a structure in which a holes are bored in a substrate to partially expose the metallic bulk body, separate terminals are connected to this exposed part of the metallic bulk body, and a power source is wired to the terminal to pass current through the heater.

If power supply terminals are connected to any portion of a network member having, for example, a circular shape, electric current flow concentrates upon a part of the network member because the current flows along the shortest current flow path. Consequently, such a part of the network member is overheated, so that a uniform temperature at the heating surface of the heater has a limit.

In view of the above, the network member is shaped in a slender band-shaped form according to another preferred embodiment of the present invention. By so doing, since current flows in a longitudinal direction of the band-shaped network member, a non-uniform temperature distribution due to the current concentration is unlikely to occur different from, for example, the circular network member. In particular, the temperature at the heating surface of the ceramic substrate can be made more uniform by evenly distributing the band-shaped network member over every portion of the ceramic substrate. From this point of view, it is more preferable that the heating surface of the ceramic substrate be almost parallel to the main plane of the network member.

Neither the plane shape of the network member nor the diameter of the wire constituting the network member is particularly limited. A metallic wire made of a pure metal having purity of 99% or more is particularly preferred, which is produced as "linear" by a rolling/drawing process. Further, the resistance of the metal constituting the metallic wire is preferably not more than $1.1\times10^{-6}$ Ω·cm and, more preferably not more than $6\times10^{-6}$ Ω·cm.

It is preferable that the thickness of the metallic wire constituting the network member is not more than 0.8 mm and the wires are crossed at a rate of 8 or more wires per inch. If the thickness of the wire is set at not more than 0.8 mm, the heat generating rate of the wire is large to make the generated heat amount appropriate. Further, if the thickness of the wire is set at not less than 0.2 mm, the current concentration due to excessive heat generation through the wires is unlikely to occur. The term "thickness" is used for wires having various sectional shapes from round to rectangular sectional shapes. With respect to wires having almost accurately circular sectional shapes, the diameter of the wires constituting the network member is preferably not less than 0.013 mm, more preferably not less than 0.02 mm.

Furthermore, when the wires are crossed at the rate of 8 or more wires per inch, current easily uniformly flows over the entire network member, and the current concentration among the wires constituting the network member rarely occurs. From the point of view of the actual production, the wire-crossing rate is preferably 100 or less wires per inch.

The widthwise-sectional shape of the wire constituting the network member may be of any rolled shape such as circular, elliptical, of rectangular shape.

Figure 2A:
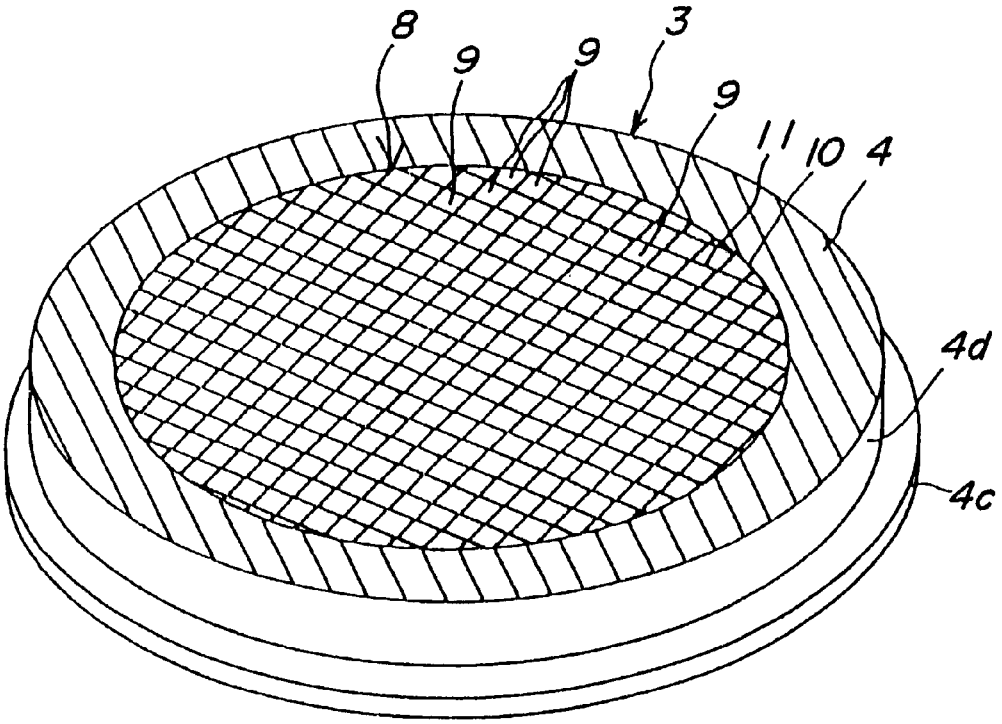
FIG. 2(*a*) is a perspective view of the ceramic heater 3 cut, and FIG. 2(*b*) is a perspective view of a network member 8.
Figure 2B:
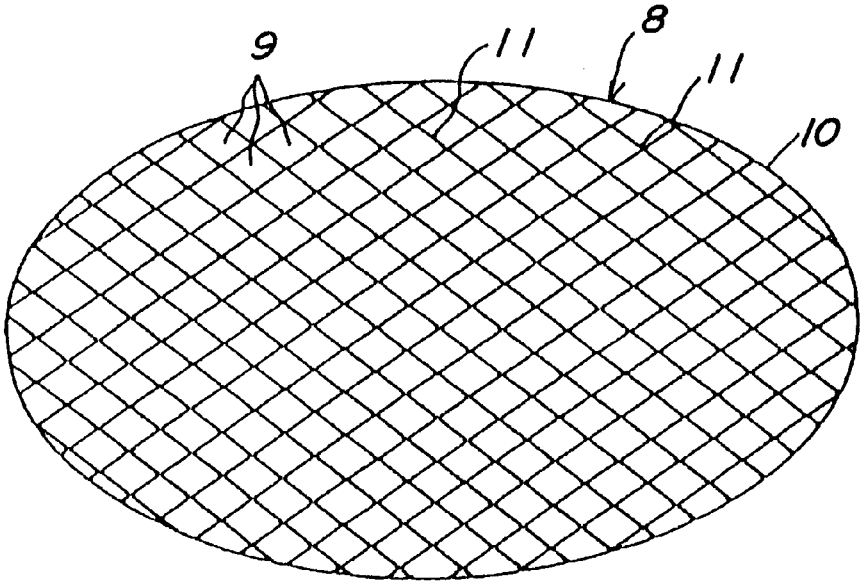

In the following, embodiments of the present invention will be explained in more detail with reference to the drawings. FIG. 1 is a sectional view schematically showing a state in which a ceramic heater 3 according to one embodiment of the present invention is placed in a chamber. FIG. 2(*a*) is a perspective view of the ceramic heater 3 cut, and FIG. 2(*b*) is a perspective view of a network member 8.

The ceramic heater 3 is placed in the chamber 1 via an arm 7. A ring-shaped flange 4*c* is provided at a peripheral face 4*d* of a ceramic substrate 4 having an almost discoid shape. A resistance-heating element made of a network member 8 is buried inside the substrate 4. A front surface layer 4*a* is provided on a side of a heating surface 3*a* for an object such as a semiconductor to be fixed thereon as viewed from the network member 8, whereas a rear surface layer 4*b* is provided on a side of a rear surface 4*e*. The surface layer 4*a* and the rear surface layer 4*b* are integrated with each other without a seam, and the network member 8 is enclosed and buried in the integrated layer. The semiconductor 2 is placed on the heating surface 3*a*.

The network member 8 constituting the resistance-heating element is constituted by wires 11 laterally and vertically knitted and a round wire 10 constituting an outer peripheral portion of the network member 8. The ceramic material is filled in a countless number of meshes defined by the wires 10 and 11, which connects the front surface layer 4*a* to the rear surface layer 4*b*.

For example, a pair of terminals 5A and 5B are buried inside the ceramic substrate 4, and one end of each terminal 5A, 5B is electrically connected to the network member, whereas the other is connected to a power supply cable 6A, 6B.

Either one of the following processes can produce the ceramic heater according to the present invention, for example.

Process 1

A preliminarily molded ceramic body is produced, and a network member is placed on the preliminarily molded body. Then, a powdery ceramic material is placed on the preliminarily molded body and the network member, which is uniaxially press molded. The thus molded body is sintered by hot press in the state that the molded body is being pressed in a thickness direction of the network member.

The pressure in the hot press needs to be not less than 50 kg/cm$^2$, and preferably not less than 100 kg/cm$^2$. Considering the performance of actual equipment, the pressure may be ordinarily set at not more than 2 ton/cm$^2$.

Figure 3A:
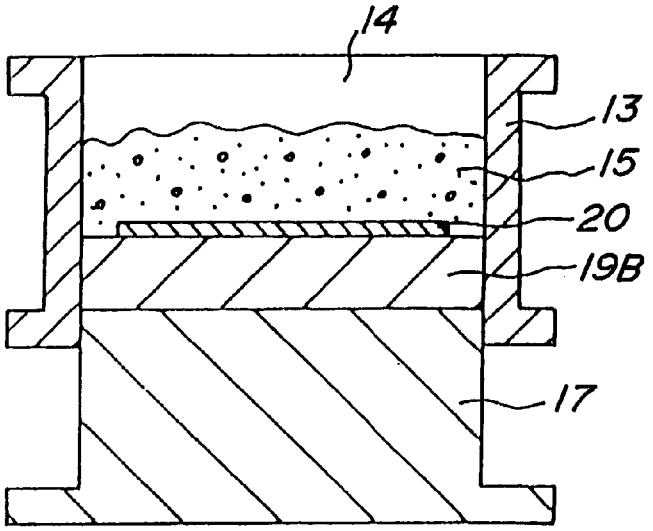
FIG. 3(*a*) is a sectional view of showing a state in which a network member and a ceramic powder are placed inside a uniaxial molding mold, and FIG. 3(*b*) a sectional view of a molded body 18.
Figure 3B:
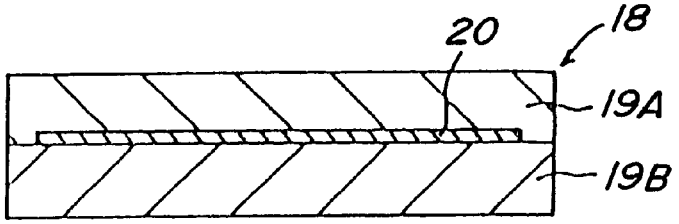

For example, a press-molding machine as schematically shown in FIG. 3(*a*) is prepared. A mold frame 13 is fitted to a lower mold unit 17 of the press-molding machine. The ceramic powder 15 is charged in an inner space 14 of the mold frame 13, which is uniaxially press molded by the lower mold unit 17 and an upper mold unit (not shown), thereby producing a preliminarily molded body 19B. A network member 10 is then placed on the preliminarily molded body 19B. The network member 210 is, for example, one obtained by knitting wires as in the network member 8 shown in FIG. 2(*b*).

Next, ceramic powder 15 is charged onto the network member 20 to bury the network member under the ceramic powder 15. The powder 15 is uniaxially press molded between the lower mold unit and the upper mold unit (not shown), thereby obtaining a molded body 18 as shown in FIG. 3(*b*). In the molded body 18, the network member 20 is buried between the preliminarily molded bodies 19A and 19B. Then, the molded body 18 is sintered by hot press, and ground, thereby producing a ceramic heater.

Process 2

Two planar molded bodies are produced by cold isostatic press, and a resistance heating element is interposed between the two planar molded bodies. In this state, the molded bodies are sintered by hot press, while the two molded bodies and the resistance heating element are being pressed in a thickness direction of the resistance heating element.

Figure 4:
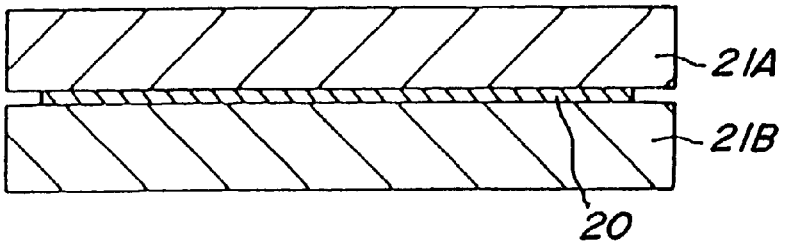
FIG. 4 is a sectional view of showing a state in which a network member 20 is interposed between CIP molded bodies 21A and 21B formed by a cold isostatic press.

For example, two planar molded bodies 21A and 21B as shown in FIG. 4 are produced by cold static pressing the ceramic powder 15. Then, a network member 20 is sandwiched between the molded bodies 21A and 21B, which is sintered by hot press in this state.

Figure 5A:
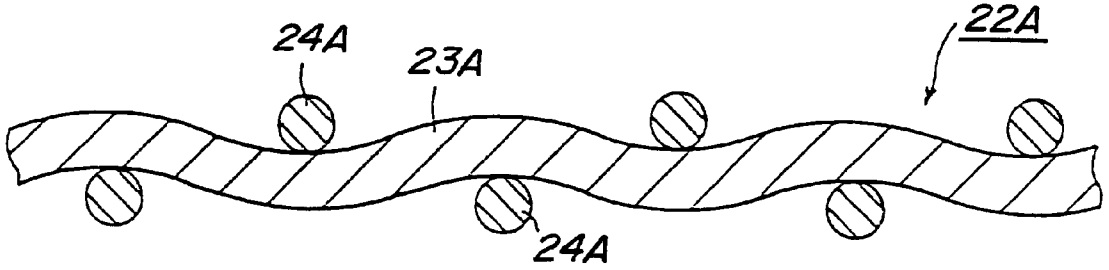
FIG. 5(*a*), FIG. 5(*b*) and FIG. 5(*c*) are sectional views of showing microstructures of network members usable in the present invention.
Figure 5B:
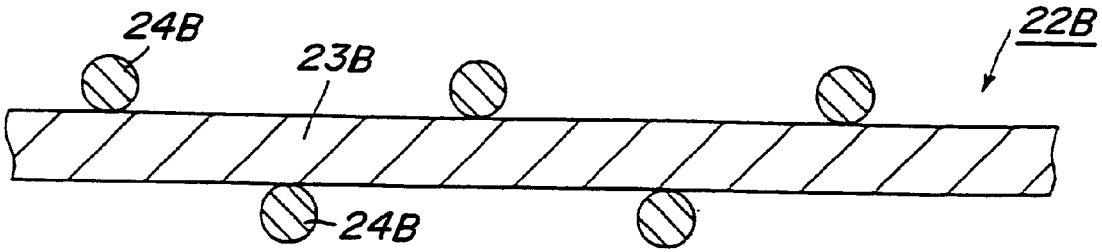
Figure 5C:
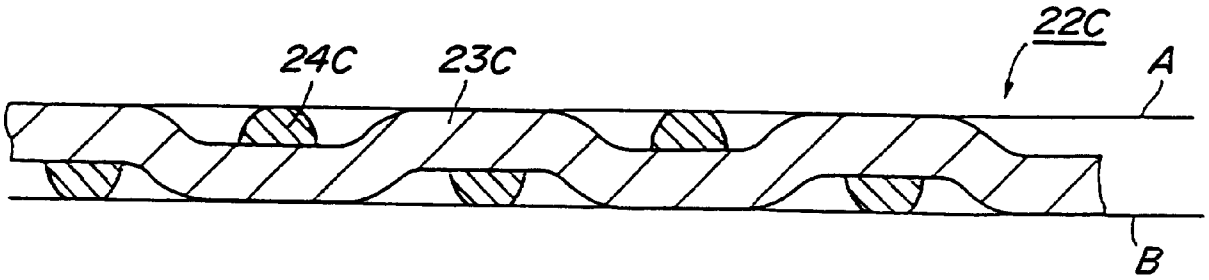

FIGS. 5(*a*) through 5(*c*) are sectional views of showing various network members by way of example. In the network member 22A shown in FIG. 5(*a*), vertical wires 24A and lateral wires 23A are three-dimensionally cross-knitted, while being all curves. In the network member of FIG. 5(*b*), the lateral wires 23B are straight, whereas lateral wires 24B are curved. In the network member 22C shown in FIG. 5(*c*), vertical wires 24C and lateral wires 23C are three-dimensionally cross-knitted, while being all curves. The network member 22C is rolled, so that the outer faces of the vertical and lateral wires extend along lines A and B.

A network member 22A made of pure molybdenum wires as shown in FIG. 5(*a*) was buried in powdery aluminum nitride, which was fired at 1800° C. by hot press. Then, a sectional face of the molybdenum wires constituting the network member was observed. This revealed that the lateral wires 23A and the vertical wires 24A were integrated, without any interface, at portions where the lateral wires 23A were crossed and contacted with the vertical wires 24A.

Each of the above network members may be favorably used as a resistance heating element of the ceramic heater. However, the network member having a rolled shape as shown in FIG. 5(*c*) is particularly preferable, because the network member has a most favorable flat degree, and the vertical and lateral wires contact one another most reliably.

Figure 6A:
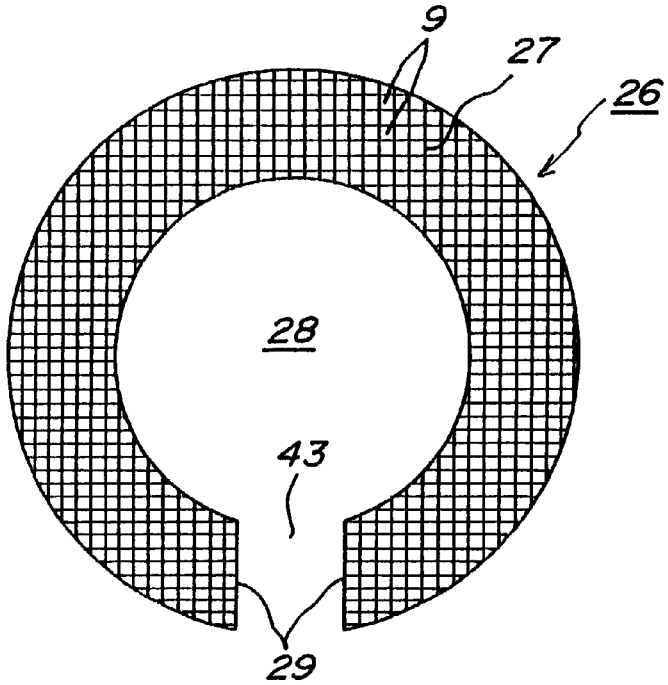
FIG. 6(*a*) is a plane view of showing a network member 26, and FIG. 6(*b*) a sectional view of schematically showing a ceramic heater 41 in which the network member of FIG. 6(*a*) is buried in a ceramic substrate.
Figure 6B:
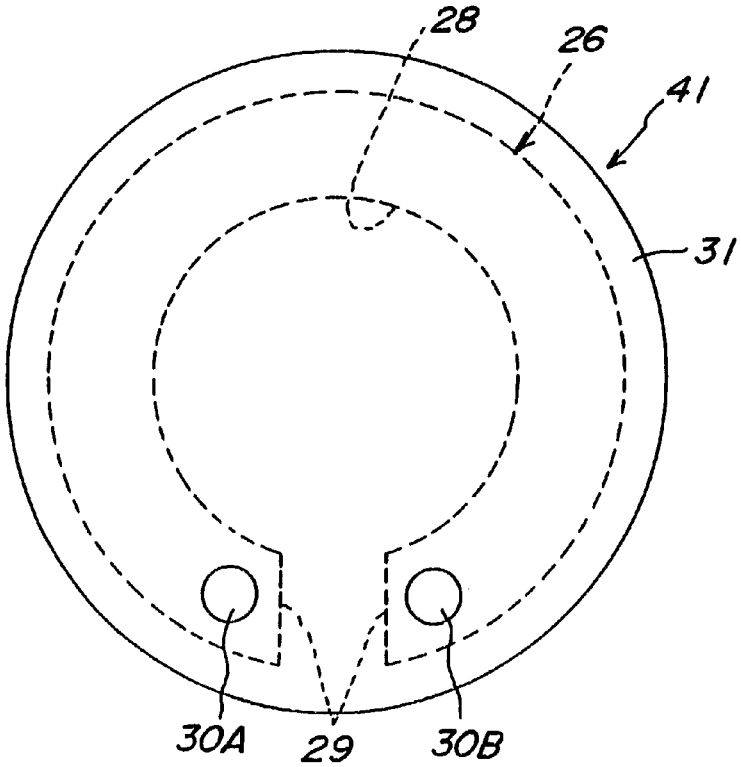

FIG. 6(*a*) is a plane view showing a network member 26 to be used in a ceramic heater as a further embodiment, and FIG. 6(*c*) is a plane view schematically showing the ceramic heater in which the network member 26 is buried.

The network member 26 is constituted by wires 27 vertically and laterally knitted together. Inner and outer peripheral sides of the network member 26 are almost circular, so that the entire network member 26 has a ring-like shape, while a round space 28 is formed inside the network member 26. A cut portion 43 is provided in the network member 26, and a pair of end portions 29 of the network member 26 face each other.

In the ceramic heater 41, the network member 26 is buried in the ceramic substrate 31. Terminals 30A, 30B are connected to a pair of the end portions 29 of the network member 26. By so doing, current flows between the terminals 30A and 30B in a circumferential direction along a longitudinal direction of the ring-shaped network member 26, thereby preventing the concentration of the current flow.

Figure 7A:
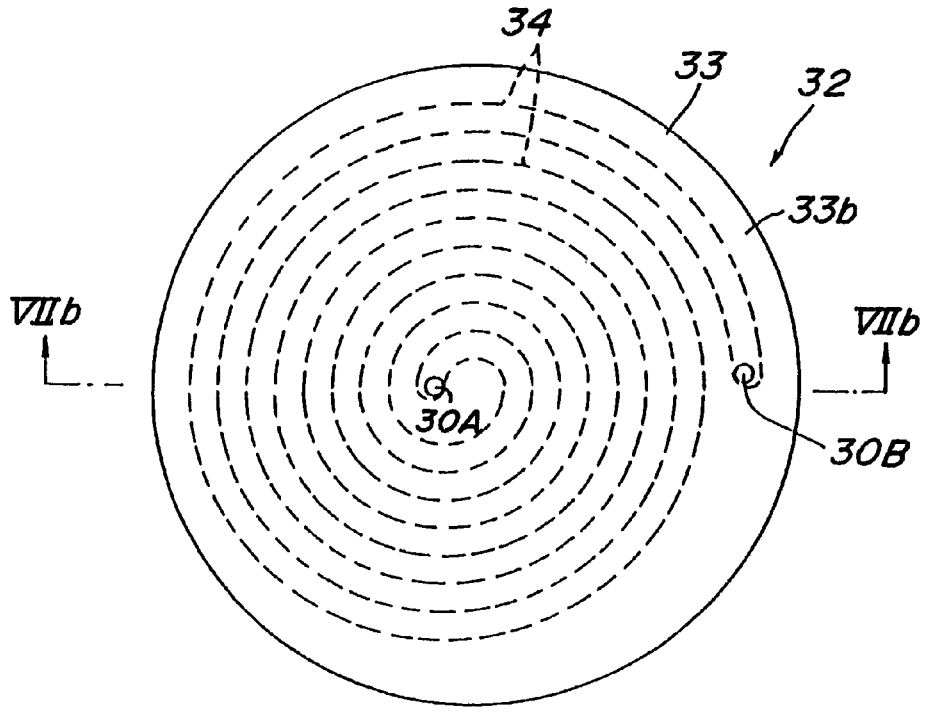
FIG. 7(*a*) is a plane view of a ceramic heater 32 according to a further embodiment of the present invention and FIG. 7*b* is a cross-sectional view thereof taken through line VIIb—VIIb of FIG. 7*a*.
Figure 7B:
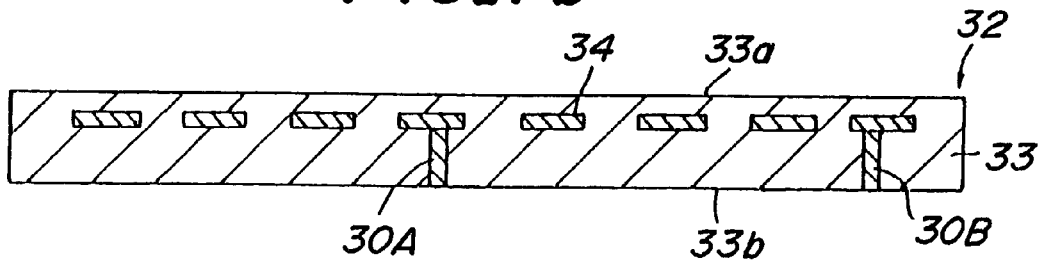

FIG. 7(*a*) is a plane view showing a ceramic heater 32 according to a further embodiment of the present invention. FIG. 7(*b*) is a cross sectional view of FIG. 7(*a*) along a line VIIb—VIIb. In the ceramic heater 32, a network member 34 is buried in a substrate 33 having, for example, a discoid shape.

A terminal 30A is buried in a central portion of the substrate 33, while an end of the terminal 30A is exposed from a rear face 33*b*. A terminal 30B is buried in a peripheral portion of the substrate 33, while an end of the terminal 30B is exposed from a rear face 33*b*. The central terminal 30A and the terminal 30B are connected via the network member 34. A reference numeral 33*a* denotes a heating surface.

The network member 34 is made of a network body as shown, for example, in FIG. 6(*a*). In FIGS. 7(*a*) and 7(*b*), illustration of fine meshes of the network member 34 is omitted due to limited dimensions of the figure. The network member 34 takes a swirling shape between the terminals 30A and 30B as viewed in plane. The terminals 30A and 30B are connected to power supply cables not shown.

EXAMPLES

Experiment A

Using a network member 26 as shown in FIG. 6(*a*) produced a ceramic heater as one of the embodiment of the present invention as shown in FIG. 6(*b*). Powdery aluminum nitride containing 5% of yttria was prepared as the ceramic powder 15. The powder and the network member 26 were uniaxially press molded according to the method explained in connection with FIGS. 3(*a*) and 3(*b*), thereby producing a molded body 18.

The network member was made of pure molybdenum. The diameter of the wires constituting the network member and the crossing number of the wires per inch were varied as shown in Table 1. The outer and inner diameters of the network member 26 were 44 mm and 28 mm, respectively.

The molded body 18 was sintered by hot press at 1900° C. under 200 kg/cm$^2$, thereby obtaining an aluminum nitride sintered body having a relative density of 99.4%. The diameter and the thickness of the ceramic substrate were 50 mm and 10 mm, respectively. Holes were bored in the substrate from its rear surface side by ultrasonic wave machining, and terminals 30A and 30B were connected to the network member 26.

Heat cycling tests were carried out with respect to each ceramic heater. More specifically, the heater was heated up to 700° C. from room temperature at a rate of 100° C./hour, held at 700° C. for one hour, and cooled down to room temperature at a rate of 100° C./hour. These steps were taken as one cycle. Such heating cycles were repeated 200 times at the maximum, and cracking was checked.

TABLE 1

| Test No. | Wire Diameter (mm) | Number of wires per inch | Heat cycling resistance |
|---|---|---|---|
| 1 | 1.0 | 5 | Substrate cracked at 8 heating cycles. |
| 2 | 0.8 | 8 | No crack observed in substrate & heating element after 200 heating cycles. |
| 3 | 0.5 | 8 | No crack observed in substrate & heating element after 200 heating cycles. |

TABLE 1-continued

| Test No. | Wire Diameter (mm) | Number of wires per inch | Heat cycling resistance |
|---|---|---|---|
| 4 | 0.35 | 80 | No crack observed in substrate & heating element after 200 heating cycles. |
| 5 | 0.35 | 30 | No crack observed in substrate & heating element after 200 heating cycles. |
| 6 | 0.35 | 15 | No crack observed in substrate & heating element after 200 heating cycles. |
| 7 | 0.2 | 120 | No crack observed in substrate & heating element after 200 heating cycles. |
| 8 | 0.2 | 30 | No crack observed in substrate & heating element after 200 heating cycles. |
| 9 | 0.15 | 50 | No crack observed in substrate & heating element after 200 heating cycles. |
| 10 | 0.12 | 50 | No crack observed in substrate & heating element after 200 heating cycles. |
| 11 | 0.12 | 60 | No crack observed in substrate & heating element after 200 heating cycles. |
| 12 | 0.10 | 120 | No crack observed in substrate & heating element after 200 heating cycles. |
| 13 | 0.05 | 200 | No crack observed in substrate & heating element after 200 heating cycles. |
| 14 | 0.03 | 50 | No crack observed in substrate & heating element after 200 heating cycles. |
| 15 | 0.02 | 100 | No crack observed in substrate & heating element after 200 heating cycles. |
| 16 | 0.013 | 100 | Heating element partially cut after 200 heating cycles. |
| 17 | 0.01 | 100 | Heating element cut at 127 heating cycles. |

As shown in Table 1, the ceramic heaters according to the present invention all exhibited high heat cycling resistance. In particular, when the diameter of the wires was set at 0.8 to 0.02 mm, it was revealed that the heat cycling resistance was remarkably enhanced.

Experiment B

Ceramic heater was produced in the same manner as in Experiment A, and subjected to the heat cycling test. A foil made of molybdenum having an outer diameter of 44 mm, an inner diameter of 28 mm and a thickness of 0.65 mm was buried as a resistance-heating element. As a result, the substrate was cracked after 15 heating cycles.

Experiment C

Ceramic heaters 32 each having a shape as shown in FIGS. 7(*a*) and 7(*b*) according to another embodiment of the present invention were produced. The specific production process was the same as in Experiment A. The outer diameter and the thickness of a substrate 33 were 200 mm and 15 mm, respectively.

As shown in FIG. 7(*a*), a network member 34 was buried inside the substrate in a spiral form as viewed in plane. The width of the network member 34 was selected among 1.5 mm, 9 mm, 15 mm and 30 mm. The diameter of the wires of the network member 34 was 0.12 mm, and the number of wires per inch was 50.

As a result, it was confirmed that each ceramic heater could be heated up to 790° C. when the width of the network member 34 was in a range of 1.5 mm to 30 mm. Further, it was confirmed that no crack occurred in the substrate even after 100 heating cycles in the heat cycling test.

Experiment D

Ceramic heaters 41 each having a shape as shown in FIGS. 6(*a*) and 6(*b*) according to a further embodiment of the present invention were produced in the same manner as in Experiment A. The outer diameter and the thickness of a substrate 31 were 50 mm and 2 mm or 4 mm, respectively. The outer and inner diameters of the network member 26 were 44 mm and 28 mm, respectively. The diameter of the wires of the network member 26 was 0.12 mm, and the number of wires per inch was 50.

As a result, it was confirmed that each ceramic heater with a substrate of 2 mm or 4 mm in thickness could be heated up to 790° C. Further, it was confirmed that no crack occurred in the substrate even after 100 heating cycles in the heat cycling test.

Experiment E

Ceramic heaters 32 each having a shape as shown in FIGS. 7(*a*) and 7(*b*) according to another embodiment of the present invention were produced in the same manner as in Experiment C. The outer diameter and the thickness of a substrate 33 were 200 mm and 4 mm, 8 mm, 12 mm or 20 mm, respectively.

As shown in FIG. 7(*a*), a network member 34 was buried inside the substrate in a spiral form as viewed in plane. The width of the network member 34 was 8 mm. The diameter of the wires of the network member 34 was 0.12 mm, and the number of the wires per inch was 50.

As a result, it was confirmed that each ceramic heater with the substrate of 4 mm, 8 mm, 12 mm or 20 mm in thickness could be heated up to 790° C. Further, it was confirmed that no crack occurred in the substrate even after 100 heating cycles in the heat cycling test.

A ceramic heater 4 having a shape as shown in FIGS. 6(*a*) and 6(*b*) according to a further embodiment of the present invention was produced. The resistance-heating element was made of a molybdenum-tungsten alloy (molybdenum 50 wt %, tungsten 50 wt %). The resistance heating element was designed such that the outer diameter and the diameter of the wires was 0.12 mm, and the number of the wires per inch was 50.

It was also confirmed that the ceramic heater could be heated up to 790° C. and that no damage occurred between the substrate and the resistance heating element even after 200 heating cycles in the heat cycling test.

As mentioned above, according to the present invention, the thickness of the ceramic substrate can be decreased in the ceramic heater where the resistance heating element is buried in the ceramic substrate, and durability of the heater can be enhanced upon application of heating cycles between the high temperature range and the room temperature range.

What is claimed is:

1. A ceramic heater comprising a ceramic substrate having a heating surface, and a resistance heating element buried inside the ceramic substrate, wherein at least a part of the resistance heating element is constituted by a conductive flat band-shaped network member having a width of 1.5 mm to 30 mm, and a ceramic material constituting the ceramic substrate is filled in meshes of the network member.

2. The ceramic heater claimed in claim 1, wherein the resistance-heating element comprises the network member and a metallic bulk body integrated with the network member.

3. The ceramic heater claimed in claim 2, wherein the heating surface of the ceramic substrate is almost in parallel to a main plane of the network member.

4. The ceramic heater claimed in claim 1, wherein the ceramic substrate is made of aluminum nitride, and the resistance heating element is made of molybdenum or a molybdenum alloy.

* * * * *